US010590706B2

(12) United States Patent
Hess et al.

(10) Patent No.: US 10,590,706 B2
(45) Date of Patent: Mar. 17, 2020

(54) ESTABLISHING HYDRAULIC COMMUNICATION BETWEEN RELIEF WELL AND TARGET WELL

(71) Applicant: Halliburton Energy Services, Inc., Houston, TX (US)

(72) Inventors: Joseph Eli Hess, Richmond, TX (US); Thomas Earl Burky, Mansfield, TX (US); Andrew John Cuthbert, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 294 days.

(21) Appl. No.: 15/573,986

(22) PCT Filed: Jul. 2, 2015

(86) PCT No.: PCT/US2015/039085
§ 371 (c)(1),
(2) Date: Nov. 14, 2017

(87) PCT Pub. No.: WO2017/003487
PCT Pub. Date: Jan. 5, 2017

(65) Prior Publication Data

US 2018/0291688 A1 Oct. 11, 2018

(51) Int. Cl.
*E21B 7/00* (2006.01)
*E21B 43/117* (2006.01)
(Continued)

(52) U.S. Cl.
CPC ..... *E21B 7/007* (2013.01); *E21B 29/02* (2013.01); *E21B 33/13* (2013.01); *E21B 43/117* (2013.01);
(Continued)

(58) Field of Classification Search
CPC ..... E21B 7/007; E21B 43/117; E21B 33/13; E21B 43/119; E21B 29/02; E21B 7/06;
(Continued)

(56) References Cited

U.S. PATENT DOCUMENTS 4,436,154 A 3/1984 Vann et al.
6,016,753 A 1/2000 Glenn et al.
(Continued)

FOREIGN PATENT DOCUMENTS

CA 2649728 C 4/2007
GB 2093500 A 9/1982
(Continued)

OTHER PUBLICATIONS

Search Report issued in related France Patent Application 1655005 dated Sep. 8, 2018, 6 pages.
(Continued)

*Primary Examiner* — Wei Wang
(74) *Attorney, Agent, or Firm* — Tenley Krueger; Baker Botts L.L.P.

(57) ABSTRACT

In accordance with embodiments of the present disclosure, systems and methods for establishing hydraulic communication between a relief wellbore and a target wellbore during relief well applications are provided. Present embodiments include a perforating gun that uses an explosively formed penetrator (EFP) to establish hydraulic communication between a relief well and the target well for well kill operations. The EFP may be detonated downhole according to the Misznay-Schardin effect, thereby releasing a projectile toward the target well to form a relatively large hole through the casing/cement between the wellbores. The EFP may be positioned in a desired orientation with respect to the target well, in order that the projectile may be directed from the relief well directly into the target well. In some embodi-
(Continued)

ments, the disclosed perforating gun may include several EFP charges positioned along one side of the gun at approximately 0 to 10 degree phasing from each other.

20 Claims, 4 Drawing Sheets

(51) Int. Cl.

| | |
|---|---|
| ***E21B 33/13*** | (2006.01) |
| ***E21B 43/119*** | (2006.01) |
| ***F42B 1/028*** | (2006.01) |
| ***E21B 29/02*** | (2006.01) |
| ***E21B 7/06*** | (2006.01) |
| ***E21B 47/024*** | (2006.01) |
| ***E21B 7/04*** | (2006.01) |
| ***E21B 41/00*** | (2006.01) |

(52) U.S. Cl.
CPC ..... *E21B 43/119* (2013.01); *F42B 1/028* (2013.01); *E21B 7/04* (2013.01); *E21B 7/06* (2013.01); *E21B 47/024* (2013.01)

(58) Field of Classification Search
CPC ..... E21B 47/024; E21B 7/04; E21B 41/0035; E21B 43/116; E21B 43/11; F42B 1/028
See application file for complete search history.

(56) References Cited

U.S. PATENT DOCUMENTS

| | | | |
|---|---|---|---|
| 6,024,169 | A | 2/2000 | Haugen |
| 6,298,915 | B1 | 10/2001 | George |
| 2010/0000397 | A1 | 1/2010 | Pratt et al. |
| 2013/0000908 | A1 | 1/2013 | Walters et al. |
| 2014/0216744 | A1 | 8/2014 | Parlin |

FOREIGN PATENT DOCUMENTS

| | | | |
|---|---|---|---|
| GB | 2521297 | A | 6/2015 |
| WO | 2014/044628 | A1 | 3/2014 |
| WO | 2015/030752 | A2 | 3/2015 |

OTHER PUBLICATIONS

Examiner's Letter issued in related Canadian Patent Application 2,988,076 dated Aug. 31, 2018, 4 pages.
International Search Report and Written Opinion issued in related PCT Application No. PCT/US2015/039085 dated Mar. 28, 2016, 14 pages.
Search Report and Written Opinion issued in related Singapore Application No. 11201709553Q dated Jun. 29, 2018, 10 pages.

ESTABLISHING HYDRAULIC COMMUNICATION BETWEEN RELIEF WELL AND TARGET WELL

CROSS-REFERENCE TO RELATED APPLICATION

The present application is a U.S. National Stage Application of International Application No. PCT/US2015/039085 filed Jul. 2, 2015, which is incorporated herein by reference in its entirety for all purposes.

TECHNICAL FIELD

The present disclosure relates generally to well kill operations in hydrocarbon exploration and, more particularly, to using explosive charges to establish hydraulic communication between a target well and a relief well during well kill operations.

BACKGROUND

In the field of hydrocarbon exploration and extraction, it is sometimes necessary to drill a relief well to provide a conduit for injecting a fluid, such as mud or cement, into a target well. Such procedures most often occur when the relief well is drilled to kill the target well. A relief well is typically drilled as a straight hole down to a planned kickoff point, where it is turned toward the target well using conventional directional drilling technology. Drilling is thereafter continued until the relief well intersects the target well, thereby establishing hydraulic communication between the two wells. Owing to the difficulty in intersecting the relief well with the target well, the relief well may be drilled at an incident angle to the target well rather than simply intersecting the target well perpendicularly.

Establishing the conduit between the relief well and the target well can be difficult due to having to drill through a section of cement and casing surrounding the target well. In some instances, the relief well is drilled so that it approaches close proximity to the target well (e.g., within 0.2-0.5 meters) but does not make contact with the target well. At this point, a system designed for establishing hydraulic communication between the two wells may be lowered through the relief well until it is in position near the target well at the closest approach. Once in place, the system can be actuated to establish hydraulic communication between the wells.

In any event, once hydraulic communication is established, the relief well may function to relieve pressure from the target well. In some instances, fluid from the relief well U-tubes into the target well. Pumps are used to keep the annulus of the relief well full, followed by pumping at the appropriate kill rates until the blowout is dead.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1A:
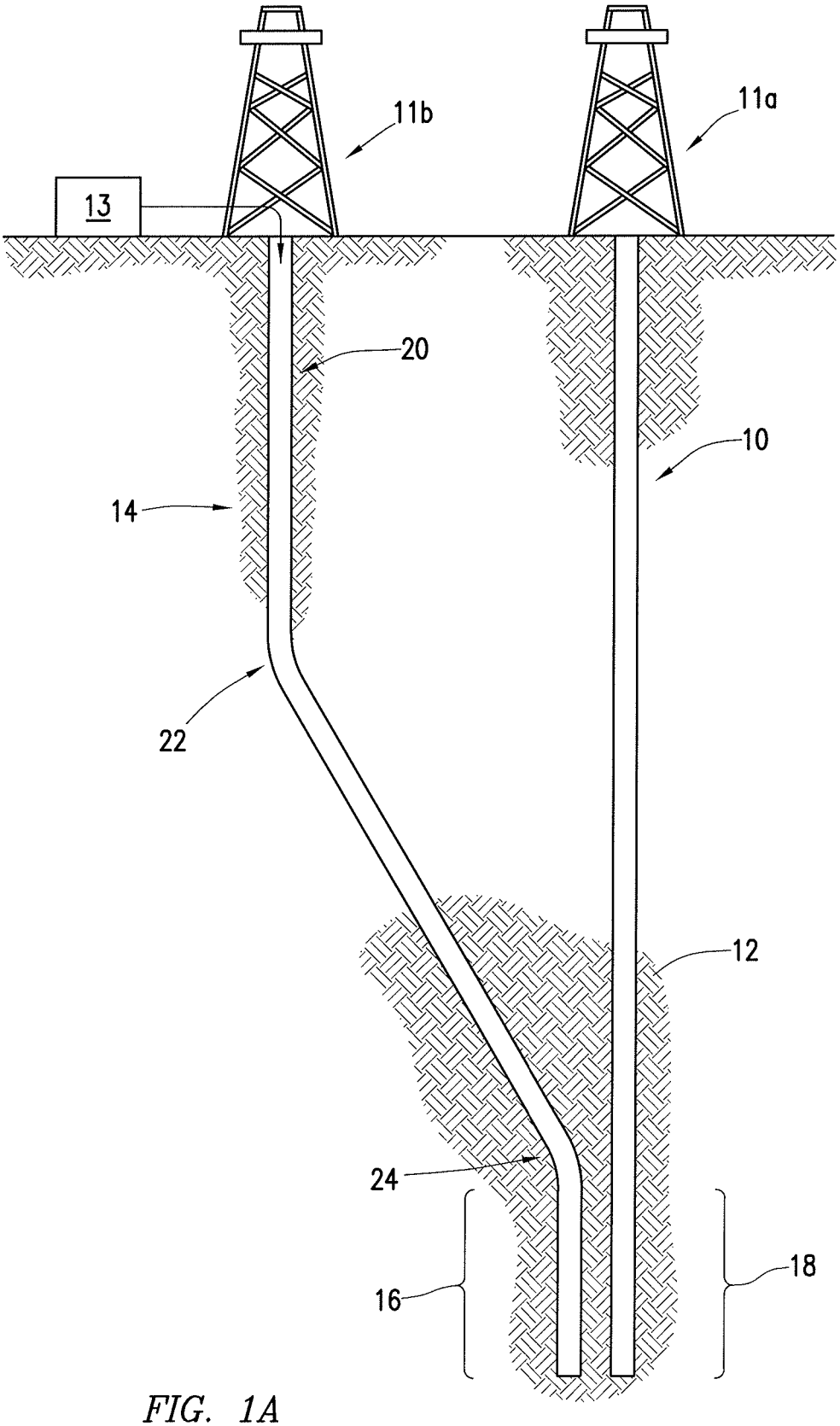
FIGS. 1A-1B are schematic partial cross-sectional views of a relief well positioned next to a target well and an explosive system used to establish communication between the relief well and the target well, in accordance with an embodiment of the present disclosure.

Illustrative embodiments of the present disclosure are described in detail herein. In the interest of clarity, not all features of an actual implementation are described in this specification. It will, of course, be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for establishing hydraulic communication between a relief wellbore and a target wellbore during relief well applications. In disclosed embodiments, a system using explosively formed penetrators (EFPs) may be used to establish communication between the wellbores. The explosive system described herein may be actuated to establish a relatively large conduit between the two wellbores for hydraulic well kill operations. In addition, the explosive system may eliminate the need to mill or drill through the formation and any casing/cement surrounding the target wellbore and/or the relief wellbore.

Different types of explosive tools have been used to provide hydraulic communication in a wellbore environment. For example, bulk explosive charges have been used to establish fluid communication downhole. Unfortunately, these bulk explosives are not always capable of penetrating the casing/cement surrounding a wellbore. When used to connect a relief well to a target well, the bulk explosive charge might cause the casing of the target well to buckle, instead of penetrating through the casing to effectively establish hydraulic communication.

In addition, attempts have been made to utilize perforating guns with conventional (i.e., conical) shaped explosive charges to establish the desired fluid communication between a relief well and a target well. These charges can penetrate through casing from two to three feet away from the casing. Even with these significant penetration depths, however, the shaped charges are very directional and therefore can miss the targeted well. Also, the resultant holes formed by the shaped charges are relatively small, which can limit the level of hydraulic communication achieved between the two wells. It can be difficult to pump a cement slurry through the relatively small holes at large enough flow rates to effectively perform the desired relief operations.

To overcome these drawbacks, present embodiments are directed to an explosive system that uses an EFP to establish hydraulic communication between a relief well and the target well for well kill operations. EFP charges may be detonated downhole using the Misznay-Schardin effect, thereby releasing a large projectile toward the target well to form a relatively large hole through the casing/cement between the two wellbores. The EFP charges may be positioned in a desired orientation with respect to the target well, in order that the projectile may be directed from the relief well directly into the target well. In some embodiments, the disclosed perforating gun may include several EFP charges positioned along one side of the gun at approximately 0 to 10 degree phasing from each other.

The disclosed perforating gun featuring one or more EFP charges may result in broader targeting of the target well due to large openings that are established through the use of the EFP charges. This may lead to better hydraulic communication established between the relief well and the target well, compared to systems that utilize conventional shaped charges or bulk explosives. Thus, the disclosed embodiments may provide a simple and effective method for establishing hydraulic communication between two wellbores in close proximity.

Figure 1B:
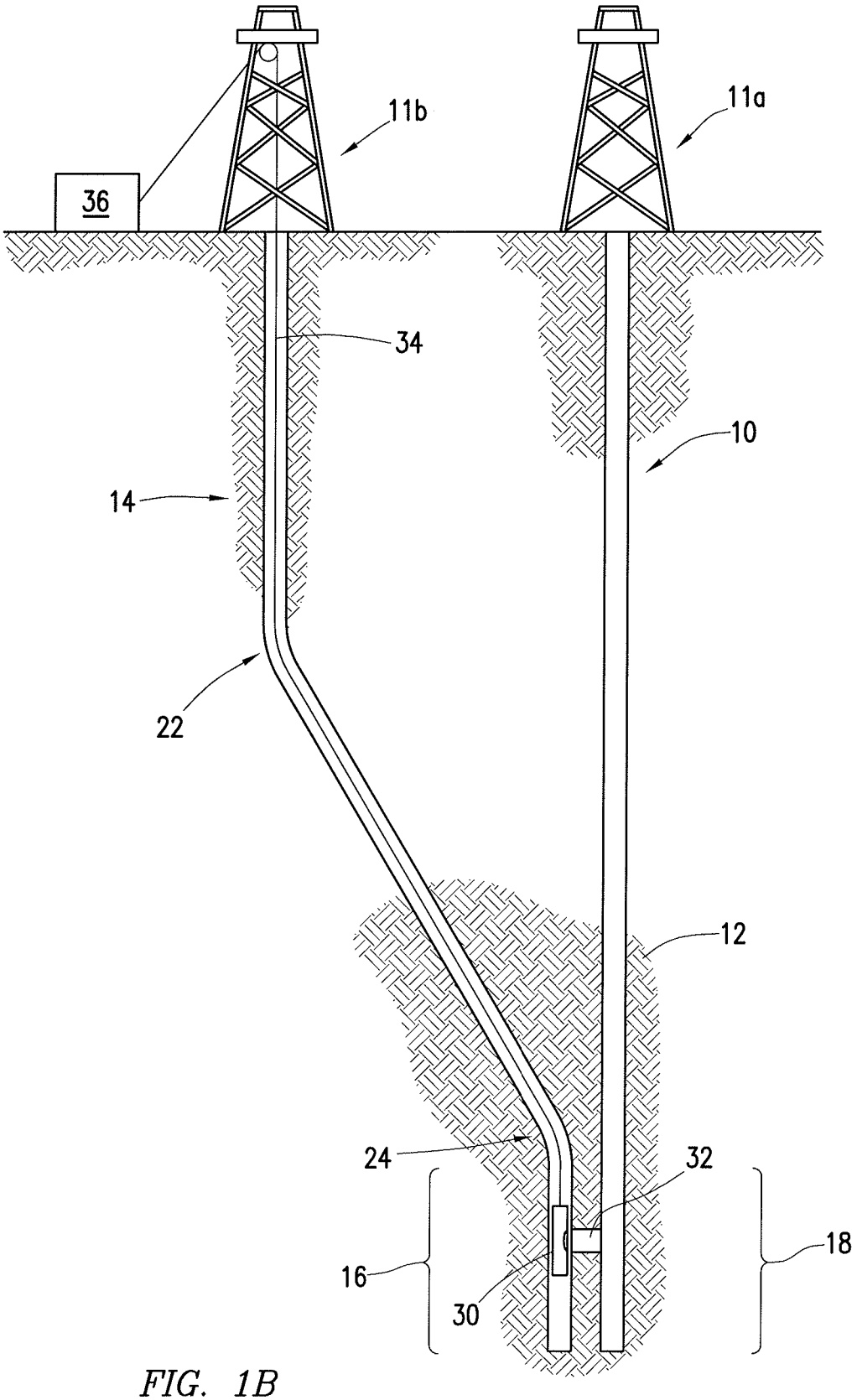

Turning now to the drawings, FIGS. 1A and 1B illustrate a wellbore environment in which the disclosed explosive system may be used. As shown in FIG. 1A, a first or target wellbore 10 is shown extending through a subterranean formation 12. Although the first wellbore 10 may have any orientation or inclination, for purposes of the discussion, the first wellbore 10 is illustrated as extending substantially vertically from a drilling structure 11*a*.

A second or relief wellbore 14 is also shown in the formation 12 and extending from a drilling structure 11*b*. The second wellbore 14 is drilled so that a portion 16 of the second wellbore 14 is disposed adjacent a portion 18 of the first wellbore 10. The drilling structures 11*a* and 11*b* are provided for illustrative purposes only and may be any type of drilling structure utilized to drill a wellbore, including land deployed drilling structures or marine deployed drilling structures. In this regard, the wellbores 10 and 14 may extend from land or may be formed at the bottom of a body of water. Also illustrated is a fluid source 13 for fluid to be introduced into the second wellbore 14. In some embodiments, the portion 16 of the second wellbore 14 is substantially parallel to the portion 18 of the first wellbore 10. The length of the respective parallel portions may be selected based on the amount of hydraulic communication necessary for a particular procedure. In certain embodiments, the length of the respective parallel portions may be approximately 10 to 40 meters, although other embodiments are not limited by such a distance.

It should be noted that the first and second wellbores 10 and 14 may not intersect at the adjacent portions 16 and 18, but may be maintained in a spaced apart relationship from one another. In some embodiments, the spacing between the two wellbores at the adjacent portions may be between approximately zero and 0.5 meters, between approximately zero and 0.3 meters, or some other distance. It should be noted that the system and method for establishing hydraulic communication between the two wellbores 10 and 14 may be more effective the closer the second wellbore 14 is to the first wellbore 10.

Although the trajectory of the second wellbore 14 need not follow any particular path so long as the portion 16 is positioned relative to the portion 18 of the first wellbore 10, as shown, the relief wellbore 14 may include a first substantially vertical leg 20. Kickoff may be initiated at a point 22 in order to guide the second wellbore 14 towards the first wellbore 10. Any directional drilling and ranging techniques may be used at this point to guide the second wellbore 14 towards the first wellbore 10. Once the second wellbore 14 has reached a desired offset distance, kickoff to a direction tangential to the wellbore 10 may be initiated at a point 24 to form the portion 16 of the second wellbore 14. One or both of the wellbores 10 and 14 may be cased at the respective portions 18 and 16.

Presently disclosed embodiments may be used to establish hydraulic communication between the second wellbore 14 and the first wellbore 10 at the respective adjacent portions 16 and 18. FIG. 1B illustrates a perforating gun 30 that may be lowered into the second wellbore 14 (i.e., relief wellbore) to the designated depth and detonated to produce a hydraulic conduit 32 extending between the two portions 16 and 18 of the wellbores 14 and 10. As described in detail below, the presently disclosed perforating gun 30 may include one or more explosively formed penetrator (EFP) charges used to form and release an explosively formed penetrator (EFP) from the wellbore 14 into the adjacent target wellbore 10 to form the conduit 32. The EFP charges may operate in accordance with the Misznay-Schardin effect, which represents the behavior of a large metal sheet upon detonation of explosive positioned proximate the sheet. As a result, the disclosed perforating gun 30 may produce an EFP that forms a penetration hole for hydraulically connecting the relief wellbore 14 to the target wellbore 10.

As illustrated, the perforating gun 30 may be part of a wireline perforating system that is lowered into the wellbore 14, for example, on a wireline 34 being unspooled from a wireline truck or structure 36. In other embodiments, however, the perforating gun 30 may be lowered into the wellbore 14 via a tubular string (such as a work string, a production tubing string, an injection string, etc.), a slickline, or coiled tubing. In still other embodiments, the perforating gun 30 may be flowed into the wellbore 14 via a surface pump, or gravitational attraction.

After the perforating gun 30 has been run in on the wireline 34 or some other conveying member to the designated depth, the perforating gun 30 may be oriented within the wellbore 14 so that the one or more EFP charges in the perforating gun 30 are facing a direction substantially toward the target wellbore 10. Once oriented within the wellbore 14, a signal provided from the surface may detonate the perforating gun 30 so that the EFP charge projects an EFP toward the target wellbore 10. The perforating gun 30 may project one or more EFPs with enough force to form penetrations extending between and hydraulically connecting the wellbores 10 and 14.

The disclosed perforating gun 30 may be employed in cased hole applications (e.g., one or both of the wellbores 10 and 14 are cased) or open hole applications (e.g., uncased wellbores 10 and 14), depending on a geological structure, density, and composition of the formation 12 at the intercept depth (e.g., portions 16 and 18). Owing to the large amount of force output from the EFPs moving away from the perforating gun 30, the resultant penetrations may breach a casing and associated cement of the relief well 14, travel through the formation 12 between the wellbores 10 and 14, and breach a casing and associated cement of the target well 10. In embodiments where both of the wellbores 10 and 14 are uncased at the portions 18 and 16, respectively, the penetrations may extend through the intervening formation 12 to form the conduit 32 connecting the wellbores 10 and 14. In embodiments where only one of the wellbores 10 and 14 is cased along this section, the penetrations may extend through the formation 12 and through the one set of casing and associated cement to form the conduit 32 connecting the two wellbores 10 and 14. The hydraulic conduit 32, once formed by the EFP projected from the perforating gun 30, may facilitate hydraulic communication by functioning as a flow channel between the two wellbores 10 and 14.

Again, the perforating gun 30 may include one or more EFP charges for forming the conduit 32 between the two wellbores 10 and 14. The EFP charges are specifically formed charges that feature a dish-shaped explosive face designed to form a relatively large projectile (i.e., EFP) upon detonation. The EFP charges do not produce deep-penetrating small-diameter holes, like conventional shaped charges used in perforating applications. Instead, the EFP charges may produce fast moving projectiles that form a relatively large diameter hole with a moderately deep penetration toward the target well 10. Therefore, the resulting conduit 32 may facilitate a more effective hydraulic flow therethrough, compared to smaller conduits formed via conventional perforating operations.

EFP charges have typically not been used in wellbore completion operations because the EFP slug can form a plug at the end of any perforations formed through a formation. Thus, the EFP can become an obstacle during subsequent formation fracturing and production operations performed through such perforations. In presently disclosed embodiments, it is desirable for the perforating gun 30 to provide full penetration between the relief wellbore 14 and the target wellbore 10 to establish hydraulic communication. Therefore, the risk of plugging of an end of the penetration/conduit 32 is not a concern as long as the conduit 32 extends fully between the two wellbores 10 and 14.

Figure 2:
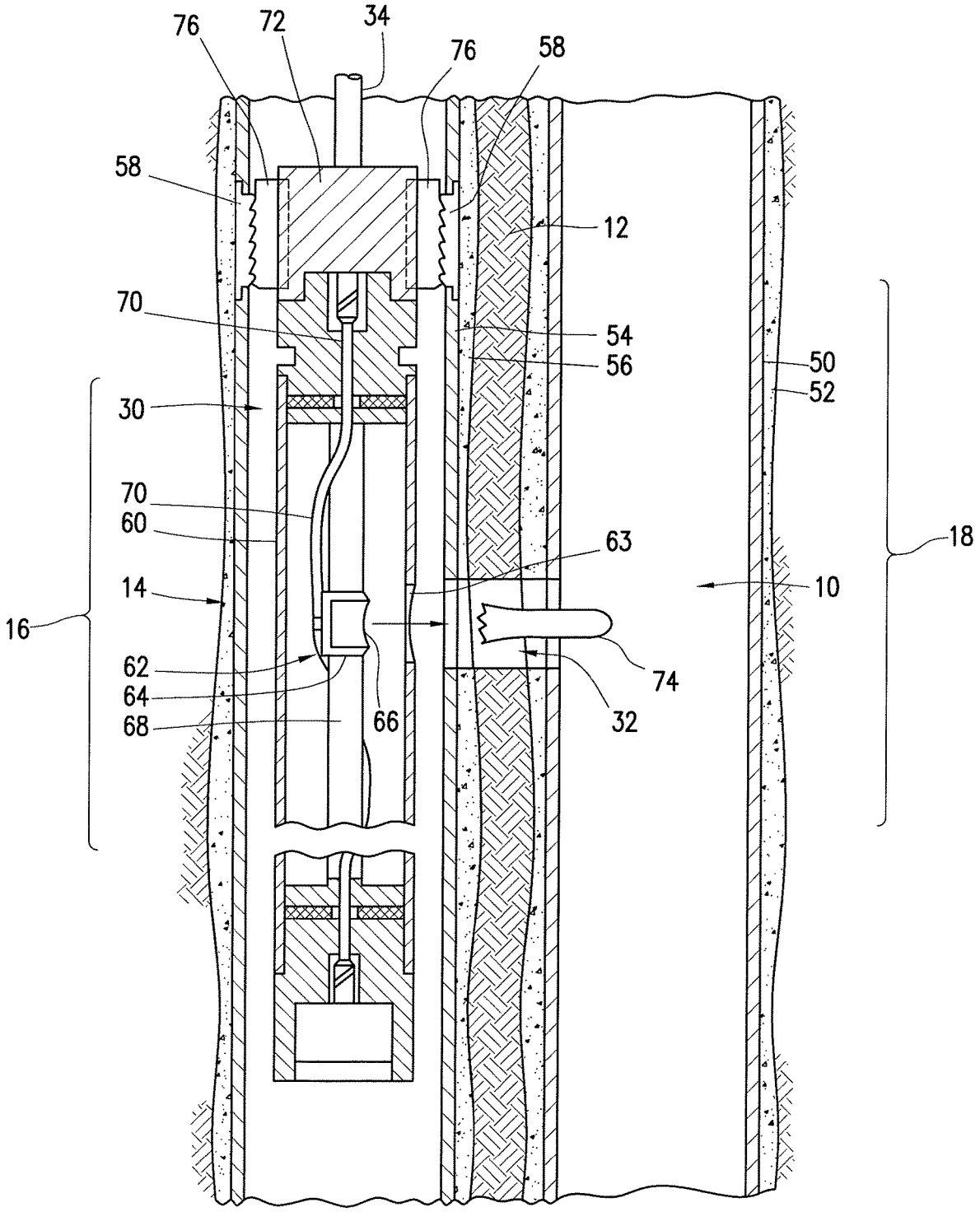
FIG. 2 is a schematic partial cross-sectional view of the explosive system of FIGS. 1A-1B, in accordance with an embodiment of the present disclosure.

Having now discussed the general method of establishing hydraulic communication between the relief wellbore 14 and the target wellbore 10 using the perforating gun 30, a more detailed description of the components of the perforating gun 30 will be provided. To that end, FIG. 2 depicts one possible assembly of the perforating gun 30 of the present disclosure.

In the illustrated embodiment, the perforating gun 30 may be disposed in the portion 16 of the relief wellbore 14, which is adjacent the portion 18 of the target wellbore 10. In the illustration, the wellbore 10 may include a casing 50, which is held in place against the formation 12 via cement 52. The casing 50 (and cement 52) is illustrated as having a relatively large penetration on one side that forms part of the conduit 32 between the two wellbores 10 and 14. This penetration through the casing 50 and cement 52, and the resulting conduit 32 between the wellbores 14 and 10, may be formed using the perforating gun 30 as described herein.

The second wellbore 14 may also include a casing 54, which is held in place against the formation 12 via cement 56. In some embodiments, the casing 54 may incorporate one or more keyed latch couplings 58 at known positions along at least a portion of the length of the casing 54. In this regard, the latch couplings 58 may be deployed at known spaced-apart intervals along the length of the portion 16 of the second wellbore 14.

It should be noted that the disclosed perforating gun 30, which uses EFP technology, is capable of forming the conduit 32 by penetrating the full thickness of both sets of casing/cement (i.e., 50, 52, 54, and 56). Although not necessary, in some embodiments, the casing 54 may include a window casing section (not shown). The window casing section may include a portion on the interior of the casing 54 with a diminished thickness (relative to the thickness of the overall casing joint) to enhance the formation of the conduit 32. Alternatively, such a window may be pre-milled in the casing 54.

As mentioned above, the perforating gun 30 may be used to form the conduit 32 between the wellbores 10 and 14, thereby establishing fluid communication between the wellbores 10 and 14. Again, the perforating gun 30 may be a wireline perforating tool carried on the wireline 34. In other embodiments, however, the perforating gun 30 may be carried on a tubular string. The perforating gun 30 may be lowered into position along the appropriate portion 16 of the wellbore 14 for forming one or more perforations outward into the formation 12 and towards the target wellbore 10. In some embodiments, the perforating gun 30 may be lowered into position adjacent a window formed in the casing 54 along the portion 16 of the wellbore 14.

Although not shown, in embodiments where the perforating gun 30 is lowered via a tubular string, the perforating gun 30 may be positioned, sealed, and secured in the casing 54 by a packer. Such a packer would seal off an annulus formed radially between the tubular string and the wellbore 14.

The perforating gun 30 may include a carrier gun body 60 made of a cylindrical sleeve with one or more EFP charges 62 disposed therein. In some embodiments, the carrier gun body 60 may include one or more radially reduced areas depicted as scallops or recesses 63, each one radially aligned with a respective one of the EFP charges 62. Each of the EFP charges 62 may include a charge case 64 and a liner 66. The liner 66 may be a metal face shaped like a shallow dish. The liner 66 may be constructed from copper, iron, tantalum, or some other metallic material that may form a slug upon detonation of the charge 62. A quantity of high explosive may be disposed between the charge case 64 and the liner 66.

As illustrated, the EFP charges 62 may be retained within the carrier gun body 60 by a charge holder 68, which in some embodiments includes an outer charge holder body and an inner charge holder body. Disposed within or around the charge holder 68 is a detonating cord 70, which is used to detonate the EFP charges 62. In other embodiments, each EFP charge 62 may be individually contained in a pressure housing, commonly called a capsule that will break up into small pieces upon detonation. This may prevent blockage of the hydraulic communication channel 32 by the gun carrier body or a portion thereof.

A firing head 72 is used to initiate firing or detonation of one or more EFP charges 62 of the perforating gun 30 (e.g., in response to a mechanical, hydraulic, electrical, optical or other type of signal, passage of time, etc.), when it is desired to form the conduit 32. Although the firing head 72 is depicted as being connected above the perforating gun 30, one or more firing heads may be interconnected in the perforating gun 30 at any location, with the location(s) preferably being connected to the EFP charges 62 by a detonation train.

Upon detonation of the EFP charge 62, the high explosive powder within the charge case 64 may explode with a force that pushes out against the liner 66, thereby shaping the liner 66 into an EFP 74 (i.e., EFP slug). The force from the explosive may propel the EFP 74 outward from the charge holder 68 and the carrier gun body 60, through the casing 54 and cement 56 surrounding the relief wellbore 14, through the formation 12, and through the cement 52 and casing 50 of the target wellbore 10 to form the conduit 32.

Due to the relatively large size of and amount of force applied to the EFP 74, the resulting conduit 32 may have a relatively large diameter and a large enough depth of penetration to breach the casing 50 of the target well 10. As a result, the disclosed perforating gun 30 may be used to form a conduit 32 large enough to support the high flow rates of cement and other fluids to be pumped between the relief wellbore 14 and the target wellbore 10. In some embodiments, the perforating gun 30 may utilize only a single EFP charge 62 to establish hydraulic communication between the wellbores 10 and 14. This is because the resulting conduit 32 formed from the single charge 62 is relatively large, compared to the multiple small perforations needed to establish hydraulic flow via conventional shaped charges.

In some embodiments, the perforating gun 30 may be constructed by mounting an appropriately sized EFP charge 62 into a gun carrier of an existing (conventional shaped charge) perforating gun. The disclosed perforating gun 30 may utilize a detonation chain that is similar to those used in traditional perforating systems as well. EFP charges are not often used in existing perforating guns because the liner of an EFP charge is typically thicker than the liner used in a standard shaped charge. In addition, EFP charges 62 may generally need a greater standoff distance between the discharge end (where the liner 66 is located) of the charge 62 and the carrier gun body 60 to properly form the EFP 74. For example, the standoff distance between the discharge end of the EFP charges 62 and a corresponding discharge side of the carrier gun body 60 may be at least approximately 0.5 times the diameter of the EFP charge 62 (i.e., diameter of the liner face). In other embodiments, the standoff distance may be at least approximately equal to the diameter of the EFP charge 62. In still other embodiments, the standoff distance may be at least approximately 2 times the diameter of the EFP charge 62.

Because of the larger thickness of the liner 66 and the greater standoff distance required for the EFP charge 62 (compared to a standard shaped charge), the form factor of the perforating gun 30 may appear such that a relatively small EFP charge 62 is disposed within a large diameter carrier gun body 60. Although in the illustrated embodiment the EFP charge 62 and charge holder 68 are positioned at a radially central location within the perforating gun 30, in other embodiments the EFP charge 62 and charge holder 68 may be disposed to one side of the perforating gun 30 to increase the available standoff distance for forming the EFP 74.

In the illustrated embodiment, the initiation end of the EFP charge 62 extends toward an outer edge of the charge holder 68 opposite the discharge end, allowing the detonating cord 70 to be wrapped around the charge holder 68. In other embodiments, however, the initiation end of the EFP charge 62 may reach a central longitudinal axis of the perforating gun 30. Such orientation of the EFP charge 62 may allow the detonating cord 70 to connect to the high explosive within the EFP charge 62 via an aperture formed longitudinally through the charge holder 68. Any number of other arrangements of the EFP charges 62, charge holder 68, and detonating cord 70 may be utilized in other embodiments of the perforating gun 30 in accordance with the present disclosure.

It may be desirable to properly orient the perforating gun 30 within the wellbore 14 such that the perforating gun 30 discharges or ignites the one or more charges 62 radially toward the target wellbore 10. To that end, one or more latches 76 may be disposed on the perforating gun 30 to axially and/or radially orient the perforating gun 30 toward the target wellbore 10 as the latches 76 are brought into engagement with the latch couplings 58 on the casing 54. In other embodiments, other types of orientation components may be utilized to orient the perforating gun 30 within the relief wellbore 14 such that the EFP charge 62 is facing the target wellbore 10. This orientation of the perforating gun 30 to output the EFP 74 toward the target wellbore 10 may enable relatively accurate aiming of the EFP charge 62 used to establish hydraulic communication between the wellbores 10 and 14.

As described above, embodiments of the EFP perforating gun 30 may include a plurality of EFP charges 62 disposed therein. These EFP charges 62 may be arranged longitudinally along the perforating gun 30 to fire multiple EFPs 74 toward the target well 10, thereby increasing the likelihood of forming a hydraulic conduit 32 between the two wellbores. In addition, the EFP charges 62 may be arranged along the perforating gun 30 in groups to produce multiple hydraulic communication conduits 32 between the two wellbores 10 and 14.

Figure 3:
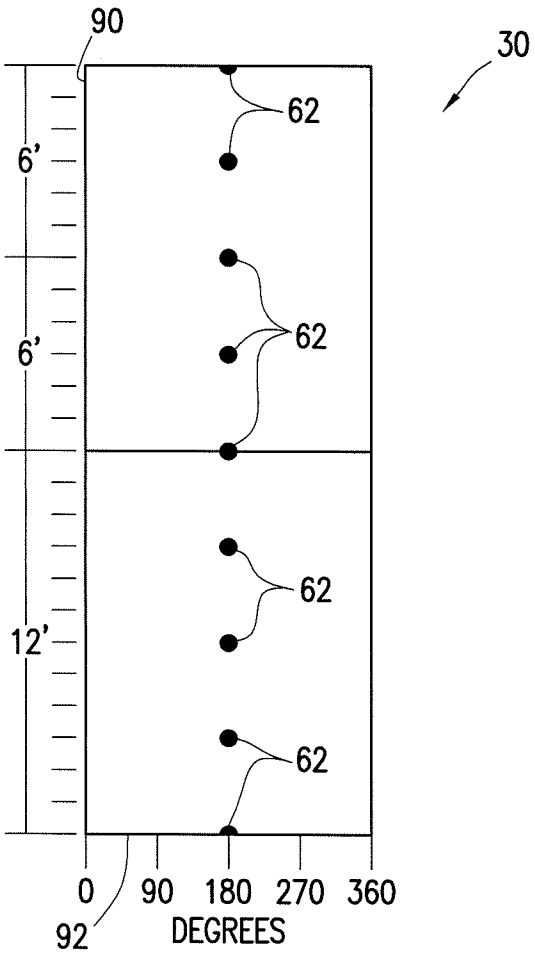
FIG. 3 is a schematic view of a radial arrangement of EFPs in the explosive system of FIGS. 1A-1B, in accordance with an embodiment of the present disclosure.

FIG. 3 illustrates one such arrangement of EFP charges 62 within a perforating gun 30. This figure illustrates generally the discharge locations where the multiple EFP charges 62 release EFPs with respect to a surface area of the perforating gun 30. That is, a first dimension 90 of the illustrated perforating gun 30 may represent a longitudinal direction of the perforating gun 30, while a second dimension 92 may represent a radial position around the perforating gun 30. For example, the illustrated EFP charges 62 that are facing the 180 degree radial position may be facing directly opposite the 0 degree and 360 degree radial positions.

As shown in FIG. 3, the EFP charges 62 may be disposed at different longitudinal positions along the perforating gun 30. For example, all of the EFP charges 62 may be disposed approximately three feet apart in the longitudinal direction. In other embodiments, multiple EFP charges 62 may be arranged longitudinally with varying amounts of separation therebetween. In the illustrated embodiment, all of the EFP charges 62 may be disposed in the carrier facing a single direction in order to fire the EFPs in generally the same radial direction. That is, the EFP charges 62 may be arranged in a firing pattern with a zero phase difference in angle of release between the multiple EFP charges 62 (e.g., all are aimed at 180 degrees). This arrangement may be particularly useful in contexts where the perforating gun 30 can be precisely oriented within the relief wellbore (e.g., via an orientation component) such that all the EFP charges 62 are directly facing the target wellbore.

Figure 4:
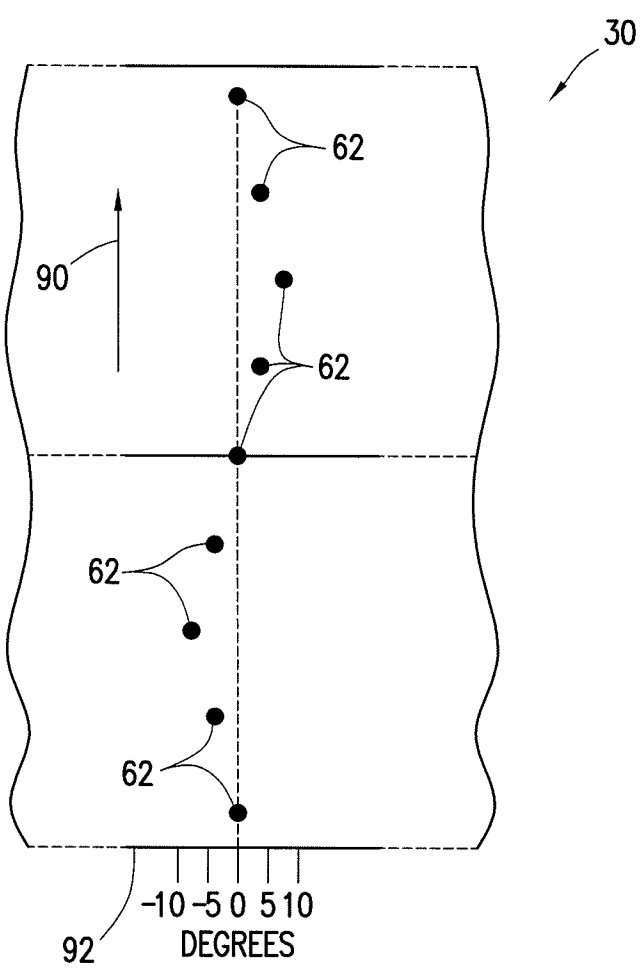
FIG. 4 is a schematic view of a radial arrangement of EFPs in the explosive system of FIGS. 1A-1B, in accordance with an embodiment of the present disclosure.

FIG. 4 illustrates another arrangement of the EFP charges 62 within the perforating gun 30 that may be utilized to establish hydraulic communication between two wellbores. In FIG. 4, the EFP charges 62 may be generally arranged on one side of the perforating gun 30. The EFP charges 62 may be positioned on the perforating gun 30 with relatively small phase angles therebetween. That is, at least two of the EFP charges 62 may be disposed in the carrier facing different directions with a nonzero phase difference in angle of release therebetween.

In the illustrated embodiment, the EFP charges 62 may be arranged with no more than approximately 10 degrees of radial offset between any two EFP charges 62. That is, each of the EFP charges 62 are disposed in the carrier with a phase difference of between approximately zero and ten degrees relative to each other EFP charge 62. In other embodiments, the EFP charges 62 may be arranged with no more than approximately 5 degrees between any two EFP charges 62.

In the illustrated embodiment, the EFP charges 62 may face different radial directions about the perforating gun 30, with approximately 5 degrees of radial offset between each subsequent EFP charge 62 taken in the longitudinal direction of the perforating gun 30.

However, the EFP charges 62 may be positioned about the perforating gun 30 in a zigzag pattern, so that the EFP charges 62 generally face the same direction away from the perforating gun 30.

Arranging the multiple EFP charges 62 about the perforating gun 30 with small phase angles in between may increase the probability of the perforating gun 30 successfully forming a conduit between the relief wellbore and the target wellbore. This arrangement of EFP charges 62 may be particularly useful in situations where the orientation of the perforating gun 30 relative to the target wellbore is imprecise due to tolerances in setting the perforating gun 30, among other uncertainties. That way, if the perforating gun 30 is slightly misaligned from the target wellbore, at least one of the EFPs projected from the perforating gun 30 may breach the target wellbore, thereby establishing hydraulic communication between the wellbores.

Embodiments disclosed herein include:

A. A system for establishing communication between a relief wellbore and a target wellbore. The system includes a perforating gun, and the perforating gun includes a body and an explosively formed penetrator (EFP) charge disposed in the body for forming and projecting an EFP from the perforating gun, through a subterranean formation between the relief wellbore and the target wellbore, and into the target wellbore, in response to a detonation of the perforating gun when the perforating gun is disposed in the relief wellbore.

B. A method including positioning a perforating gun downhole within a relief wellbore at a position proximate a target wellbore, wherein the perforating gun includes at least one explosively formed penetrator (EFP) charge. The method also includes detonating the EFP charge to form and project an explosively formed penetrator (EFP) from the perforating gun, through a subterranean formation between the relief wellbore and the target wellbore, and into the target wellbore to establish hydraulic communication between the relief wellbore and the target wellbore.

Each of the embodiments A and B may have one or more of the following additional elements in combination: Element 1: wherein the perforating gun further includes a plurality of EFP charges disposed in the body for forming and projecting a respective plurality of EFPs from the perforating gun in response to a detonation of the perforating gun. Element 2: wherein each of the plurality of EFP charges are disposed in the body facing a single direction with zero phase difference in an angle of release of the plurality of EFP charges. Element 3: wherein at least two of the plurality of EFP charges are disposed in the body facing different directions with a nonzero phase difference in an angle of release therebetween, and wherein each of the plurality of EFP charges are disposed in the body with a phase difference of between approximately zero and ten degrees relative to each other of the plurality of EFP charges. Element 4: wherein the plurality of EFP charges are disposed in a zigzag arrangement along a length of the perforating gun. Element 5: further including an orientation component coupled to the perforating gun for orienting the perforating gun within the relief wellbore such that the EFP charge is facing the target wellbore. Element 6: wherein the EFP charge is disposed along a central longitudinal axis of the body. Element 7: wherein the EFP charge is disposed along a first side of the body and aimed to project the EFP toward a second side of the body opposite the first side. Element 8: wherein the body includes a recess formed partially through a discharge side of the body for enabling release of the EFP from the perforating gun. Element 9: further including a wireline coupled to the perforating gun for lowering the perforating gun to a specified depth within the relief wellbore where the relief wellbore is proximate the target wellbore. Element 10: further including a tubular string coupled to the perforating gun for lowering the perforating gun to a specified depth within the relief wellbore where the relief wellbore is proximate the target wellbore.

Element 11: further including penetrating at least one layer of casing and at least one layer of cement via the EFP projected from the perforating gun to establish hydraulic communication between the relief wellbore and the target wellbore. Element 12: further including penetrating a layer of casing and cement surrounding the relief wellbore and a layer of casing and cement surrounding the target wellbore. Element 13: further including forming a conduit between the relief wellbore and the target wellbore, and pumping concrete through the relief wellbore and into the target wellbore. Element 14: further including forming the EFP based on the Misznay-Schardin effect via a dish-shaped explosive face of the EFP charge. Element 15: further including directing the EFP a distance between approximately zero and 0.3 meters between the relief wellbore and the target wellbore. Element 16: further including detonating a plurality of EFP charges disposed in the perforating gun, wherein the plurality of EFP charges are all facing a single direction to project a plurality of EFPs at approximately the same angle toward the target wellbore. Element 17: further including detonating a plurality of EFP charges disposed in the perforating gun to project a plurality of EFPs from the perforating gun at a range of angles between approximately zero and ten degrees about a longitudinal axis of the perforating gun. Element 18: further including orienting the perforating gun within the relief wellbore via an orientation component such that the EFP charge faces the target wellbore.

Although the present disclosure and its advantages have been described in detail, it should be understood that various changes, substitutions and alterations can be made herein without departing from the spirit and scope of the disclosure as defined by the claims.

What is claimed is:

1. A system for establishing communication between a relief wellbore and a target wellbore, comprising:

a perforating gun comprising:

a body; and an explosively formed penetrator (EFP) charge disposed in the body for forming and projecting an EFP from the perforating gun, through a subterranean formation between the relief wellbore and the target wellbore, and into the target wellbore, in response to a detonation of the perforating gun when the perforating gun is disposed in the relief wellbore.

2. The system of claim 1, wherein the perforating gun further comprises a plurality of EFP charges disposed in the body for forming and projecting a respective plurality of EFPs from the perforating gun in response to a detonation of the perforating gun.

3. The system of claim 2, wherein each of the plurality of EFP charges are disposed in the body facing a single direction with zero phase difference in an angle of release of the plurality of EFP charges.

4. The system of claim 2, wherein at least two of the plurality of EFP charges are disposed in the body facing different directions with a nonzero phase difference in an angle of release therebetween, and wherein each of the plurality of EFP charges are disposed in the body with a phase difference of between approximately zero and ten degrees relative to each other of the plurality of EFP charges.

5. The system of claim 4, wherein the plurality of EFP charges are disposed in a zigzag arrangement along a length of the perforating gun.

6. The system of claim 1, further comprising an orientation component coupled to the perforating gun for orienting the perforating gun within the relief wellbore such that the EFP charge is facing the target wellbore.

7. The system of claim 1, wherein the EFP charge is disposed within the body with a standoff distance of at least approximately 0.5 times the diameter of the EFP charge between a discharge end of the EFP charge and a discharge side of the body.

8. The system of claim 1, wherein the EFP charge comprises a dish-shaped explosive face to form the EFP based on the Misznay-Schardin effect.

9. The system of claim 1, further comprising a wireline coupled to the perforating gun for lowering the perforating gun to a specified depth within the relief wellbore where the relief wellbore is proximate the target wellbore.

10. The system of claim 1, further comprising a tubular string coupled to the perforating gun for lowering the perforating gun to a specified depth within the relief wellbore where the relief wellbore is proximate the target wellbore.

11. A method, comprising:

positioning a perforating gun downhole within a relief wellbore at a position proximate a target wellbore, wherein the perforating gun comprises at least one explosively formed penetrator (EFP) charge; and detonating the EFP charge to form and project an explosively formed penetrator (EFP) from the perforating gun, through a subterranean formation between the relief wellbore and the target wellbore, and into the target wellbore to establish hydraulic communication between the relief wellbore and the target wellbore.

12. The method of claim 11, further comprising penetrating at least one layer of casing and at least one layer of cement via the EFP projected from the perforating gun to establish hydraulic communication between the relief wellbore and the target wellbore.

13. The method of claim 12, further comprising penetrating a layer of casing and cement surrounding the relief wellbore and a layer of casing and cement surrounding the target wellbore.

14. The method of claim 11, further comprising forming a conduit between the relief wellbore and the target wellbore, and pumping concrete through the relief wellbore and into the target wellbore.

15. The method of claim 11, further comprising forming the EFP based on the Misznay-Schardin effect via a dish-shaped explosive face of the EFP charge.

16. The method of claim 11, further comprising forming and projecting the EFP across a standoff distance of at least approximately 0.5 times the diameter of the EFP charge between a discharge end of the EFP charge and a discharge side of the perforating gun.

17. The method of claim 11, further comprising directing the EFP a distance between approximately zero and 0.3 meters between the relief wellbore and the target wellbore.

18. The method of claim 11, further comprising detonating a plurality of EFP charges disposed in the perforating gun, wherein the plurality of EFP charges are all facing a single direction to project a plurality of EFPs at approximately the same angle toward the target wellbore.

19. The method of claim 11, further comprising detonating a plurality of EFP charges disposed in the perforating gun to project a plurality of EFPs from the perforating gun at a range of angles between approximately zero and ten degrees about a longitudinal axis of the perforating gun.

20. The method of claim 11, further comprising orienting the perforating gun within the relief wellbore via an orientation component such that the EFP charge faces the target wellbore.

* * * * *